US009647388B1

(12) United States Patent
Ray et al.

(10) Patent No.: US 9,647,388 B1
(45) Date of Patent: May 9, 2017

(54) MINIATURIZED HDMI PLUG WITH PLUG-IN RETENTION FEATURE

(71) Applicant: All Systems Broadband, Inc., Livermore, CA (US)

(72) Inventors: Craig Dwayne Ray, Fuquay-Varina, NC (US); Michael D. Collins, Holly Springs, NC (US)

(73) Assignee: All Systems Broadband, Inc., Livermore, CA (US)

( * ) Notice: Subject to any disclaimer, the term of this patent is extended or adjusted under 35 U.S.C. 154(b) by 0 days.

(21) Appl. No.: 15/239,110

(22) Filed: Aug. 17, 2016

(51) Int. Cl.

| | |
|---|---|
| ***H01R 24/00*** | (2011.01) |
| ***H01R 13/627*** | (2006.01) |
| ***H01R 13/502*** | (2006.01) |
| ***H01R 13/405*** | (2006.01) |
| ***H01R 13/26*** | (2006.01) |
| ***H01R 24/62*** | (2011.01) |
| *H01R 107/00* | (2006.01) |

(52) U.S. Cl.
CPC ..... *H01R 13/6275* (2013.01); *H01R 13/26* (2013.01); *H01R 13/405* (2013.01); *H01R 13/5025* (2013.01); *H01R 24/62* (2013.01); *H01R 2107/00* (2013.01)

(58) Field of Classification Search
CPC ..... H01R 23/7073; H01R 23/7005
USPC ..... 439/660, 626, 374, 377, 733, 79
See application file for complete search history.

(56) References Cited

U.S. PATENT DOCUMENTS

| | | | | |
|---|---|---|---|---|
| 8,287,299 | B2 | 10/2012 | Ray et al. | |
| 9,350,125 | B2 * | 5/2016 | Jones | H01R 24/60 |
| 9,437,984 | B2 * | 9/2016 | Golko | H01R 13/516 |
| 9,478,905 | B2 * | 10/2016 | Golko | H01R 13/516 |
| 9,484,680 | B2 * | 11/2016 | Davuluri | H01R 13/6597 |
| 2008/0200058 | A1 * | 8/2008 | Tsai | H01R 13/6583 439/353 |
| 2009/0239406 | A1 * | 9/2009 | Amidon | H01R 13/6275 439/353 |
| 2012/0094522 | A1 * | 4/2012 | Ray | H01R 13/6273 439/357 |

FOREIGN PATENT DOCUMENTS

| | | |
|---|---|---|
| CN | 203787679 U | 8/2014 |

* cited by examiner

*Primary Examiner* — Phuongchi T Nguyen
(74) *Attorney, Agent, or Firm* — Murphy, Bilak & Homiller, PLLC

(57) ABSTRACT

A high-definition multimedia interface (HDMI) plug includes a plug body section including a rigid outer shell that includes a roof section, a floor section, and a front-facing side. A male HDMI connector shell is secured to the rigid outer shell. A retention clamp is disposed within the plug body section and the male HDMI connector shell. The retention clamp includes an anchor, a flexing arm, and a tooth disposed at an end of the flexing arm. The anchor is vertically stabilized by a first interior liner that physically couples an upward-facing surface of the anchor to the roof section, and a second interior liner that physically couples a downward-facing surface of the anchor to the floor section.

19 Claims, 7 Drawing Sheets

1B

1A

MINIATURIZED HDMI PLUG WITH PLUG-IN RETENTION FEATURE

TECHNICAL FIELD

The present invention generally relates to cable assemblies for use with audio and video equipment.

BACKGROUND

HDMI (High-Definition Multimedia Interface) is a compact audio/video interface for transmitting digital data between equipment, such as between a satellite television receiver or a Digital Video Disc (DVD) player and a television monitor. Previous interconnection technologies, such as radio-frequency (RF) coaxial cable, composite video, S-video, etc., relied on analog transmission. HDMI provides a high quality digital alternative.

HDMI cables have become increasingly prevalent in consumer applications. This increased deployment coincides with a general increase in complexity associated with household audio and video systems. One problem that has been noted with HDMI cables in particular is a susceptibility to poor or incomplete connections, since the HDMI connectors of standard configuration have a tendency to come loose from movement or vibration of the audio/video equipment. This problem can be quite costly. For instance, cable television operators frequently deploy technicians to consumers' homes to resolve loss-of-picture complaints that turn out to be loose connections at an HDMI port.

U.S. Pat. No. 8,257,299 to Ray (hereinafter "the Ray patent"), which is incorporated by reference herein in its entirety, describes an HDMI plug assembly that is designed to form a secure connection with a corresponding female HDMI receptacle. The HDMI plug assembly described in the Ray patent includes a slot-shaped opening in the wall of the connector body (i.e., the male HDMI plug section that interfaces with the corresponding female HDMI receptacle). A movable tooth extends outward from the slot-shaped opening. The tooth engages with a leading edge of the female HDMI receptacle when the connector body is fully inserted into the female HDMI receptacle. The engaged tooth provides a secure connection that resists low-level pull out forces applied to the HDMI cable. When a sufficient pull out force is applied to the movable tab, the movable tab retreats downward so as to release the plug from the leading edge of the female HDMI receptacle. The features of the tooth can be controlled such that the movable tab remains engaged with the leading edge of the female HDMI receptacle at low-level forces that correspond to unintentional pulling on the HDMU cable, but releases at a higher level force threshold (e.g., 8.8 lbs.), which protects the mating HDMI receptacle and components connected thereto from damage.

There is a strong desire in the industry to minimize and simplify the plug portion of HDMI cables. By reducing the volumetric footprint of the plug and cable portions, an HDMI connection can be effectuated in much smaller spaces and induce much lower loads on the ever shrinking new equipment. For instance, in the case of a wall-mounted television, a smaller-sized pug portion coupled with a less rigid cable/plug interface will dramatically improve the clearance between the television and wall. A smaller footprint can also beneficially reduce component cost. However, miniaturizing and simplifying HDMI plugs with retention features, such as the HDMI plug assembly described in the Ray patent, presents numerous design challenges, as the smaller footprint makes it difficult to provide a movable tab that will function properly and will maintain adequate retention over repeated plug-in/plug-out cycles.

SUMMARY

A high-definition multimedia interface (HDMI) plug is disclosed. According to an embodiment, the HDMI plug includes a plug body section including a rigid outer shell, the rigid outer including a roof section, a floor section vertically spaced apart from the roof section, and a front-facing side connected to the roof and floor section, the front-facing side and roof and floor section collectively enclosing an interior volume. The HDMI plug further includes a male HDMI connector shell that is secured to the rigid outer shell and longitudinally extends away from the front-facing side. The HDMI plug further includes a retention clamp disposed within the interior volume and the male HDMI connector shell, the retention clamp including an anchor disposed within the interior volume, a flexing arm that extends away from the anchor and through the male HDMI connector shell, and a tooth disposed at an end of the flexing arm that extends out of a first opening in the male HDMI connector shell. The HDMI plug further includes first and second pin housings that are disposed in the interior volume and secured to the rigid outer shell, and first and second interior liners that are disposed in the interior volume between the rigid outer shell and the retention. The anchor includes a widest longitudinal section that is defined by an upward-facing surface, a downward-facing surface, and a generally planar rear-facing surface extending between the upward and downward-facing surfaces, the upward-facing and downward-facing surfaces each forming a substantially right angle with the rear-facing surface. The rear-facing surface is flush against the first and second pin housings, wherein the upward-facing surface is flush against the first interior liner, and wherein the downward-facing surface is flush against the second interior liner.

According to another embodiment, the HDMI plug includes a plug body section including a rigid outer shell, the rigid outer including a roof section, a floor section vertically spaced apart from the roof section, and a front-facing side connected to the roof and floor section, the front-facing side and roof and floor section collectively enclosing an interior volume. The HDMI plug further includes a male HDMI connector shell that is secured to the rigid outer shell and longitudinally extends away from the front-facing side. The HDMI plug further includes a retention clamp disposed within the interior volume and the male HDMI connector shell, the retention clamp including an anchor disposed within the interior volume, a flexing arm that extends away from the anchor and through the male HDMI connector shell, and a tooth disposed at an end of the flexing arm that extends out of a first opening in the male HDMI connector shell. The anchor is vertically stabilized within the interior volume by a first interior liner that physically couples an upward-facing surface of the anchor to the roof, and a second interior liner that physically couples a downward-facing surface of the anchor to the floor.

According to another embodiment, the HDMI plug includes a plug body section including a rigid outer shell, the rigid outer including a roof section, a floor section vertically spaced apart from the roof section, and a front-facing side connected to the roof and floor section, the front-facing side and roof and floor section collectively enclosing an interior volume. The HDMI plug further includes a male HDMI connector shell that is secured to the rigid outer shell and longitudinally extends away from the front-facing side. The HDMI plug further includes a retention clamp disposed within the interior volume and the male HDMI connector shell, the retention clamp including an anchor disposed within the interior volume, a flexing arm that extends away from the anchor and through the male HDMI connector shell, and a tooth disposed at an end of the flexing arm that extends out of a first opening in the male HDMI connector shell. The HDMI plug further includes an anchoring cavity disposed within the interior volume, the anchoring cavity having a complementary shape as the anchor and being engaged with the anchor. The anchor includes a widest longitudinal section that is defined by an upward-facing surface, a downward-facing surface, and a generally planar rear-facing surface extending between the upward and downward-facing surfaces, the upward-facing and downward-facing surfaces each forming a substantially right angle with the rear-facing surface. The anchoring cavity includes a first vertical surface that is flush against a rear-facing surface of the widest longitudinal section of the anchor, a first longitudinal surface that is flush against an upward-facing surface of the widest longitudinal section of the anchor, and a second longitudinal surface that is flush against a downward-facing surface of the widest longitudinal section of the anchor.

Of course, the present invention is not limited to the above features and advantages. Indeed, those skilled in the art will recognize additional features and advantages upon reading the following detailed description, and upon viewing the accompanying drawings.

BRIEF DESCRIPTION OF THE DRAWINGS

FIGS. 1A and 1B, depicts a standard-plug-size size HDMI cable and a smaller-plug-size size HDMI cable, according to an embodiment. FIG. 1A depicts an isometric view of both cables and FIG. 1B depicts an overhead view of both cables.

FIGS. 6A and 6B, depicts a cross-sectional view of the smaller-plug-size size HDMI cable and the longitudinal forces applied to the retention clamp, according to an embodiment. FIG. 6A depicts the longitudinal forces applied during an unplugging operation. FIG. 6B depicts the longitudinal forces applied during a plug-in operation.

DETAILED DESCRIPTION

Embodiments described herein include smaller-plug-size HDMI cable with a retention clamp that is configured to engage the leading edge of a female HDMI receptacle and provide increased plug-out resistance when the smaller-plug-size HDMI cable is plugged in. The retention clamp includes an anchor that is disposed within the plug body section, a flexing arm that extends away from the anchor and through a male HDMI connector shell, and a tooth disposed at an end of the flexing arm that extends out of the male HDMI connector shell. The interior volume of the plug body section includes an anchoring cavity that has a complementary shape and engages with the anchor so as to maintain the anchor in a fixed position.

The features of the smaller-plug-size HDMI allow for a very small footprint for the plug portion without compromising the functionality or durability of the retention features.

For example, an end portion of the anchor has a cubic shape, with a generally planar rear-facing surface, and upward-facing and downward-facing surfaces that each form substantially right angles with the rear-facing surface. The generally planar rear-facing surface is flush against the pin housings so as to provide longitudinal stability. The upward-facing and downward-facing surfaces are flush against interior liners, which physically couple these surfaces to the roof and floor of the plug body section so as to provide vertical stability. This configuration allows the retention clamp to be disposed completely in front of a pair molded plastic pin housings that are disposed in a front section of the plug body section. This in turn enables a shorter overall length for the retention clamp in comparison to conventional designs.

In addition, the flexing arm includes a step-shaped transition between a thicker portion and a thinner portion. The step-shaped transition is disposed generally above a front-facing side of the rigid outer shell of the plug body section so as to physically support a fulcrum of a lever that is created by the step-shaped transition. The height of the step-shaped transition is limited to prevent the flexing arm from deflecting too far during the plug-in or plug-out procedure. This enables a shorter overall length for the retention clamp without compromising the spring force of the retention clamp over repeated plug-in/plug-out cycles.

Figure 1:
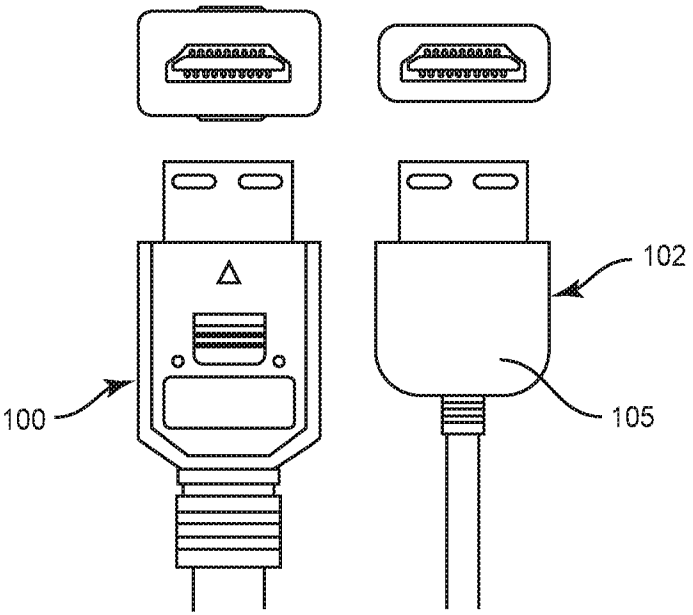
FIG. 1, which includes
Figure 1:
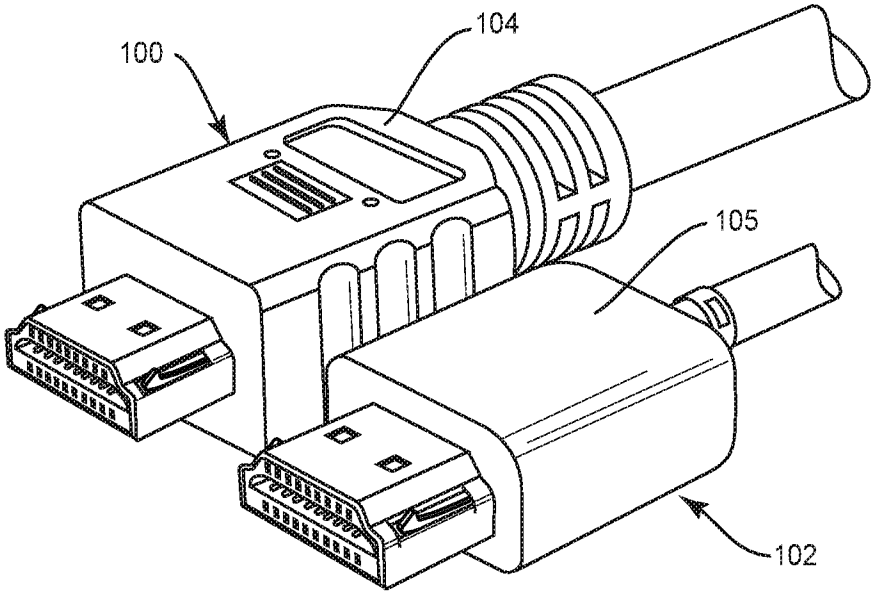

FIG. 1 depicts two HDMI cables that with plug-in retention features. In the figures, a standard-plug-size HDMI cable 100 is depicted adjacent to a smaller-plug-size HDMI cable 102. Both the standard-plug-size HDMI cable 100 and the smaller-plug-size HDMI cable 102 can be compliant with any of the various HDMI specifications, including HDMI versions 1.0, 1.1, 1.2, 1.3, 1.4, 2.0 and 2.1. Moreover, the standard-plug-size size HDMI cable and the smaller-plug-size HDMI cable 102 can have any HDMI connector type, including HDMI type A, HDMI type B, HDMI type C, HDMI type D, HDMI type E. Moreover, the connector type at one end of these cables may be the same or different as the connector at an opposite end of the cable. According to an embodiment, the depicted connector of the standard-plug-size HDMI cable 100 and the smaller-plug-size HDMI cable 102 is a male HDMI type A connector, with dimensions of about 13.9 mm×4.45 mm.

The standard-plug-size HDMI cable 100 and the smaller-plug-size HDMI cable 102 differ with respect to the size of the plug body section. According to an embodiment, the plug body section 104 of standard-plug-size HDMI cable 100 is approximately [X]. According to an embodiment, the plug body section 105 of smaller-plug-size HDMI cable 102 is approximately [X].

Figure 2:
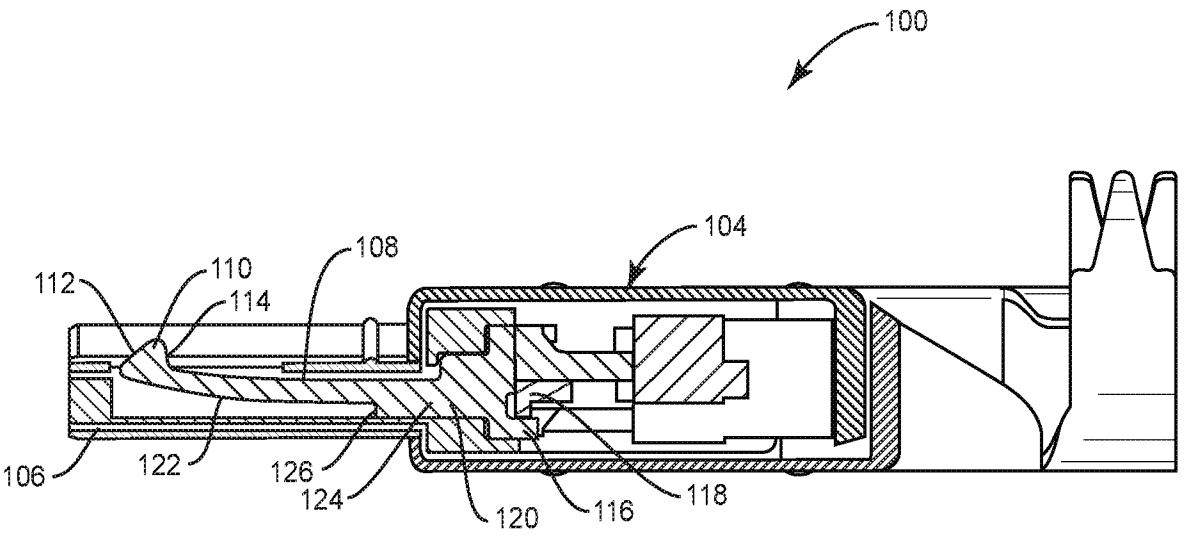
FIG. 2 (PRIOR ART)
FIG. 2 depicts a cross-sectional view of the standard-plug-size size HDMI cable, according to an embodiment.

Referring to FIG. 2, a cross-sectional view of the standard-plug-size HDMI cable 100 is depicted. The cross-section is taken along a vertical plane that includes the plug body section 104, the male HDMI connector shell 106, and the retention clamp 108. To briefly summarize the cable retention design of the standard-plug-size HDMI cable 100, the standard-plug-size HDMI cable 100 is configured such that a retention clamp 108 will flex downward based upon the appropriate application of force to a tooth 110 disposed at an end of the retention clamp 108. The tooth 108 includes an outward-facing side 112 and an inward-facing side 114 that are each disposed at oblique angles, relative to the female HDMI receptacle (not shown). As the standard-plug-size HDMI cable 100 is inserted into the female HDMI receptacle, the outward-facing side 112 contacts the female HDMI receptacle and causes the retention clamp 108 to flex downward. Once the male connector of the standard-plug-size HDMI cable 100 is sufficiently deep into the female HDMI receptacle, the tooth 110 of the retention clamp 108 passes over a leading edge of the female HDMI receptacle. Spring force causes the retention clamp 108 to flex upward such that the tooth 110 of the retention clamp 108 is engaged with the leading edge of the female HDMI receptacle. The tooth 110 of the retention clamp 108 remains engaged with the leading edge of the female HDMI receptacle until a plug-out force applied to the plug a predefined value (e.g., approx. 6 or 7 lbs.). When the plug-out force threshold is exceeded, the inward-facing side 114 of the tooth 110 transfers enough downward force on the retention clamp 108 to push the retention clamp 108 into a retreated position.

Notable features of the retention clamp 108 include a lower foot portion 116 that extends beneath a lower pin housing 118. This feature keeps the anchor 120 of the retention clamp 108 in a fixed vertical position while the flexing arm 122 of the retention clamp 108 is vertically flexed upward and the plug-in and plug-out operation. Another notable design feature of the retention clamp 108 is a thicker portion 124 of the flexing arm 122 that extends out into the male HDMI connector 106. The flexing arm 122 includes a step-shaped transition 126 where the flexing arm transitions from the thicker portion 124 to a thinner portion. The space between the thinner portion and the male HDMI connector 106 provides clearance for the flexing arm 122 to move downward during the plug-in and plug-out operation. The step-shaped transition 126 acts as a pivot point for the flexing arm. The thicker portion 124 provides a relatively strong base for the flexing arm 122 that is capable of enduring repeated plug-in and plug-out operations.

Figure 3:
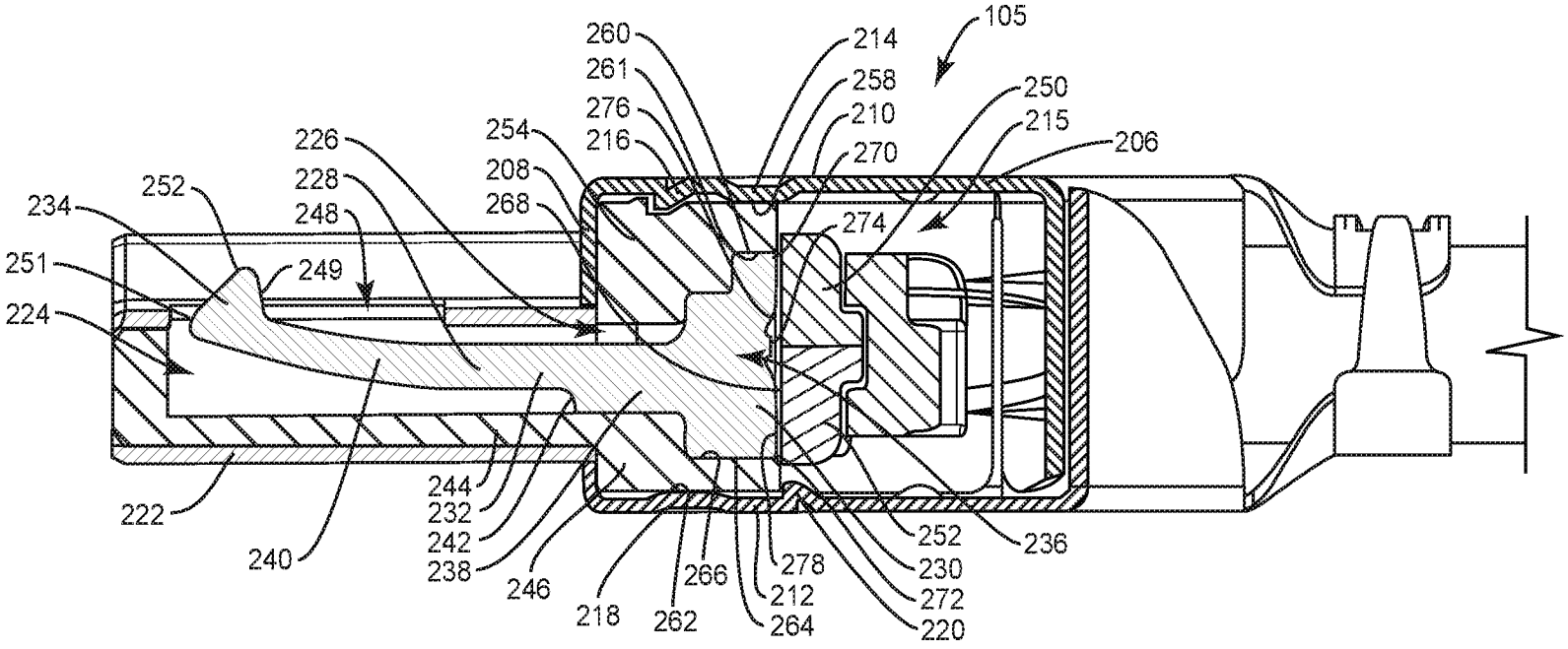
FIG. 3 depicts a cross-sectional view of the smaller-plug-size size HDMI cable, according to an embodiment.

Referring to FIG. 3, a corresponding cross-sectional view of the smaller-plug-size HDMI cable 102 is depicted. The smaller-plug-size HDMI cable 102 includes a plug body section 104 that includes a rigid outer shell 206. The rigid outer shell 206 includes a front-facing side 208 and roof and floor sections 210, 212 that enclose an interior volume 215, i.e., a three dimensional space. According to an embodiment, the front-facing side 208 is perpendicular to the roof and floor sections 210, 212. The roof section 210 can be mostly planar, but includes first and second depressed portions 214, 216 that vertically extend downward into the interior volume 215. Likewise, the floor section 212 can be can be mostly planar, but includes first and second elevated portions 218, 220 that vertically extend upward into the interior volume 215. The rigid outer shell 206 can be formed by any relatively strong formable sheet metal, such as aluminum and alloys thereof. The outside of the rigid outer shell 206 can encapsulated by an electrical insulator, such as rubber or plastic, e.g., in the manner depicted in FIG. 1.

The smaller-plug-size HDMI cable 102 further includes a male HDMI connector shell 222 that longitudinally extends away from the front-facing side 208. The male HDMI connector shell 222 has the shape of a standardized HDMI connector (e.g., type A, B, C, etc.) and is secured to the rigid outer shell 206 by an interlocking feature, for example. The male HDMI connector shell 222 encloses an interior chute 224 that contains HDMI connector pins for mating with a corresponding female HDMI receptacle. The interior chute 224 is in open communication with the interior volume 215 via an opening 226 in the front-facing side 208 of the rigid outer shell 206. According to an embodiment, the sidewalls of the male HDMI connector shell 222 are perpendicular to the front-facing side 208.

The smaller-plug-size HDMI cable 102 further includes a retention clamp 228. The retention clamp 228 includes an anchor 230, a flexing arm 232, and a tooth 234. The anchor 230 is disposed in the interior volume 215 of the plug body section 104, and is retained in a fixed position within the interior volume 215 by an anchoring cavity 236.

The flexing arm 232 longitudinally extends away from the anchor 230 section and transitions from the interior volume 215 into the interior chute 224 of the male HDMI connector shell 222. The flexing arm 232 includes a thicker portion 238, a thinner portion 240, and a step-shaped transition 242 between the thicker portion 238 and the thinner portion 240. The thicker portion 238 directly adjoins the anchor 230 and longitudinally extends from the interior volume 215 into the male HDMI connector shell 222. The thinner portion 240 directly adjoins the thicker portion 238 and longitudinally extends to the tooth 234. The step-shaped transition 242 mainly extends in the vertical direction, but may be oriented at a slightly oblique angle relative to the male HDMI connector shell 222. The thicker portion 238 of flexing arm 232 is flush against an elongated portion 244 of a second interior liner 246 that extends from the interior volume 215 into the male HDMI connector shell 222.

The tooth 234 protrudes out of a first slot-shaped opening 248 in the male HDMI connector shell 222. The tooth 234 includes an inward-facing side 249 and an outward-facing side 251. The inward-facing side 249 and the outward-facing side 251 are both oriented at oblique angles relative to the top sidewall of the male HDMI connector shell 222. The exact angle values of the inward-facing side 249 and the outward-facing side 251 may vary. In the depicted embodiment, the inward-facing side 249 almost perpendicular with the top sidewall of the male HDMI connector shell 222, whereas the outward-facing side 251 is oriented closer to a 45-degree angle with respect to the top sidewall of the male HDMI connector shell 222. This configuration enables a high degree of retention when the smaller-plug-size HDMI cable 102 is plugged in, as most of the pull out force induces longitudinal strain in the flexing arm 232 and minimal downward force. By contrast, the gentler slope of the tooth 234 on the outward-facing side causes the flexing arm 232 to deflect downward upon the application of a small amount of longitudinal force during a plug-in operation.

The smaller-plug-size HDMI cable 102 further includes first and second pin housings 250, 252 that are disposed in the interior volume 215. The first and second pin housings 250, 252 accommodate the pin sets are used to effectuate the HDMI connection. The first and second pin housings 250, 252 are made from a formable material, such as molded plastic. Conducive HDMI pins (not shown) protrude out of the first and second pin housings 250, 252 and into the male HDMI connector shell 222. The first and second pin housings 250, 252 may have a nineteen pin configuration, which is associated with a Type A or Type C HDMI plug. In such a configuration the first (upper) pin housing 250 accommodates a nine pin set, and the second (lower) pin housing 252 accommodates a ten pin set. The first and second pin housings 250, 252 may alternatively be configured with different numbered pin configurations, including the 29-pin Type B plug specified in the HDMI 1.0 specification, and the Type D plug described in the HDMI 1.4 specification. The first and second pin housings 250, 252 are secured to the rigid outer shell 206, or the male HDMI connector shell 222, or both. The details of this connection will be further described with reference to FIG. 4.

The smaller-plug-size HDMI cable 102 further includes first and second interior liners 254, 246. The first interior liner 256 is disposed in an upper region of the interior volume 215 between the roof section 210 and the anchor 230 of the retention clamp 228. The second interior liner 246 is disposed in a lower region of the interior volume 215 between the floor of the rigid outer shell 206 and the anchor 230 of the retention clamp 228. The second interior liner 246 additionally includes an elongated section 244 that extends out of the plug body section 104 and into a lower side of the male HDMI connector shell 222. The first and second interior liners 254, 246 can be made from any solid formable material, including molded plastic. The first and second interior liners 254, 246 are generally inelastic structures that transmit any force applied on one side to an opposing side with little or no compression.

The first and second pin housings 250, 252 and the first and second interior liners 254, 246 collectively form an anchoring cavity 236 within the interior volume 215 that has a complementary (i.e., inverse) shape as the anchor 230. The anchoring cavity 236 is sized such that there is no clearance or a negligible amount of clearance between the surfaces of the anchoring cavity 236 and the anchor 230. That is, the surfaces of the anchoring cavity 236 are flush against the surfaces of the anchor 230. Moreover, the components of the plug that provide the anchoring cavity 236 are physically coupled with the rigid outer shell 206 so as to maintain the anchor 230 in a fixed position despite the application of force to the anchor 230 (e.g., in the form of leverage applied by the flexing arm 232 as the smaller-plug-size HDMI cable 102 is subjected to plug-in and plug-out).

The first and second interior liners 254, 246 provide physical coupling between the anchor 230 and the rigid outer shell 206 by making direct contact with both of these structures. More particularly, the first interior liner 256 has a first surface 258 that is flush against the first depressed portion 214 of the roof section 210, and a second surface 260 that faces in an opposite direction as the first surface 258, and is flush against an upward-facing surface 261 of the anchor 230. Likewise, the second interior liner 246 has a first surface 262 that is flush against the first elevated portion 218 of the floor section 212, and a second surface 264 that faces in an opposite direction as the first surface 262, and is flush against a downward-facing surface 266 of the anchor. Due to the inelastic property of the first and second interior liners 254, 246, any vertical force applied by the anchor 230 to the first and second interior liners 254, 246 is transmitted to the roof and floor sections 210, 212 of the rigid outer shell 206. Thus, the first interior liner 256 physically couples the anchor 230 to the roof section 210 so as to prevent the anchor 230 from vertically moving towards the roof section 210, and the second interior liner 246 physically couples the anchor 230 to the floor section 212 of the rigid outer shell 206 so as to prevent the anchor 230 from vertically moving towards the floor section 212. The second depressed portion 216 of the roof section 210 and the second elevated portion 220 of the floor section 212 provide attrition al retention of the anchor 230 in place. The second depressed portion 216 of the roof section 210 engages with the first interior liner 256 so as to physically couple the two together and to provide enhanced longitudinal stability. Likewise, the second elevated portion 220 of the floor section 212 engages with the second interior liner 246 so as to physically couple the two together and to provide enhanced longitudinal stability.

The first and second interior liners 254, 246 and the first and second pin housings 250, 252 collectively stabilize the anchor 230 in the longitudinal direction. In the depicted embodiment, the first and second pin housings 250, 252 form a planar surface that faces and is flush against the rear-facing surface 268 of the anchor 230. Thus, any longitudinal force applied to the anchor 230 away from the front-facing side 208 is transferred to the first and second pin housings 250, 252. The first and second pin housings 250, 252 are securely affixed to the rigid outer shell 206 so as to resist this longitudinal force.

In the depicted embodiment, a widest longitudinal section of the anchor 230 that contacts the first and second pin housings 250, 252 has a cubic shape. The widest longitudinal section includes an upward-facing surface 261 and a downward-facing surface 266 that is vertically spaced apart from the upward-facing surface 261. According to an embodiment, the upward-facing surface 261 and the downward-facing surface 266 of the widest longitudinal section are parallel to one another. The widest longitudinal section further includes a rear-facing surface 268 that vertically extends between the upward-facing surface 261 and the downward-facing surface 266 of the widest longitudinal section. According to an embodiment, the rear-facing surface 268 forms a substantially right angle with the upward-facing and downward-facing surfaces 262, 266. That is, the rear-facing surface 268 is substantially perpendicular to and directly adjoins the upward-facing and downward-facing surfaces 262, 266. Optionally, the widest longitudinal section may include first and second rounded corners 270, 272 that provide transitions between the upward-facing and downward-facing surfaces 262, 266, respectively, and the rear-facing surface 268.

According to an embodiment, the rear-facing surface 268 of the widest longitudinal section is generally planar. Generally planar means that a substantial majority (e.g., 90% or more) of the rear-facing surface 268 extends along a single plane. In the depicted embodiment, most of the rear-facing surface 268 is planar, with the exception of a small notch-shaped remnant feature 274 disposed at a central location of the rear-facing surface 268. The notch-shaped remnant feature 274 is a remnant of a snap-off support structure associated with the production of the retention clamp 228. The snap-off support structure is used to provide a set of the retention clamps 228 together in an array so that each retention clamp 228 can be easily separated from the others. Nominally, the notch-shaped remnant feature 274 is as small as possible and skewed towards an upper half of the anchor 230. Outside of the notch-shaped remnant feature 274, the rear-facing surface 268 includes first and second planar surfaces 276, 278 that are coplanar with one another. These first and second planar surfaces 276, 278 of the rear-facing surface 268 each form a substantially right angle with the upward-facing and downward-facing surface 262, 266 respectively.

The first and second interior liners 254, 246 and the first and second pin housings 250, 252 collectively provide an anchoring cavity 236 with planar surfaces that are completely flush against all of the planar surfaces of the widest longitudinal section of the anchor 230. For example, the front-facing surface of the first and second pin housings 250, 252 is flush against an entire length of the first and second planar surfaces 276, 278 of the anchor 230. Likewise, the second surfaces 260, 264 of the first and second interior liners 254, 246 are flush against an entire length of the upward-facing and the downward-facing surfaces 262, 266 of the anchor 230, respectively. The anchoring cavity 236 therefore maximizes the area of directly contacted surfaces between the anchor 230 and the structures that hold the anchor 230 in place, and therefore produces a stable connection.

According to an embodiment, the step-shaped transition 242 in the flexing arm 232 is located generally above the front-facing side 208 of the rigid outer shell 206. Generally above the front-facing side 208 of the rigid outer shell 206, within the meaning of the present Specification, means that the longitudinal distance between the step-shaped transition 242 and the front-facing side 208 is no greater than five percent of the longitudinal distance between the longitudinal end of the flexing arm 232 and the front-facing side 208 of the rigid outer shell 206. According to a specific embodiment, the longitudinal distance between the step-shaped transition 242 and the front-facing side 208 is 2.7 percent of the longitudinal distance between the longitudinal end of the flexing arm 232 and the front-facing side 208. More generally, the step-shaped transition 242 can be located directly above the front-facing side 208 of the rigid outer shell 206 so as to longitudinally align with the front-facing side 208. A small degree of longitudinal deviation is also permitted, but this deviation may not exceed five percent of the longitudinal distance between the longitudinal end of the flexing arm 232 and the front-facing side 208.

According to an embodiment, the height of the step-shaped transition 242 is generally equal to a thickness of the elongated section 244 of the second interior liner 246. The thicknesses of the elongated section 244 and the height of the step-shaped transition 242 are both measured in the vertical direction. The thickness of the elongated section 244 of the of the second interior liner 246 is measured in a portion of the second interior liner 246 that is disposed inside of the male HDMI connector shell 222. The height of the step-shaped transition 242 is measured as a difference between the thickness of the thicker portion 238 at a location that is directly adjacent to the step-shaped transition 242 and the thickness of the thinner portion 240 in a location that is directly adjacent to the step-shaped transition 242. The height of the step-shaped transition 242 is generally equal to a thickness of the elongated section 244 of the second interior liner 246 within the meaning of the present Specification, if the height of the step-shaped transition 242 is within ten percent of a thickness (i.e., between ninety percent and one hundred ten percent) of the elongated section 244.

A comparison between FIGS. 2 and 3 reveals several notable changes to the design of the retention feature that enable a reduced footprint for the plug body section 104. One difference between the two designs is that the lower foot portion 116 of the retention clamp 108 in the standard-plug-size HDMI cable 100 has been eliminated in the smaller-plug-size HDMI cable 102. This enables a reduction in size for the retention clamp 228 of the smaller-plug-size HDMI cable 102, as the anchor 230 section of the retention clamp 228 is relegated to a front section of the interior volume 215 that is completely in front of the first and second pin housings 250, 252. That is, in the smaller-plug-size HDMI cable 102, no parts of the retention clamp 228, including the anchor 230, longitudinally extend behind the first and second pin housings 250, 252. Because the smaller-plug-size HDMI cable 102 does not include the lower foot portion 116, another mechanism is needed to provide vertical stability for the retention clamp 228. This vertical stability is provided by the first and second interior liners 254, 246 in conjunction with the depressed portion of the roof and the elevated portion of the floor in the manner previously discussed. By way of comparison, in the design of the standard-plug-size HDMI cable 100, there is a gap between the interior liners and the roof and floor sections of the exterior shell.

Another notable difference between the design of the smaller-plug-size HDMI cable 102 and the standard-plug-size HDMI cable 100 pertains to location of the step-shaped transition 242 relative to the front-facing side 208 of the rigid outer shell 206. In the standard-plug-size HDMI cable 100, the step-shaped transition 126 is not disposed generally above the front-facing side 2 of the rigid outer shell. In the standard-plug-size HDMI cable 100, the length between the step-shaped transition 126 and the front-facing side 208 is about 7.4 percent of an overall length between the front-facing side and the longitudinal end of the flexing arm. By moving the step-shaped transition 242 of the smaller-plug-size HDMI cable 102 directly above or substantially close to directly above the front-facing side 208 of the rigid outer shell 206, a shorter, more compact base design for the retention clamp 228 is achieved without compromising the durability of the retention clamp 228. As the smaller-plug-size HDMI cable 102 is plugged in and out of a female HDMI receptacle, the thinner portion 240 of the flexing arm 232 moves up and down, with the step-shaped transition 242 providing a fulcrum about which the thinner portion 240 of the flexing arm 232 pivots. This produces mechanical stress in the retention clamp 228, some of which is distributed to the adjacent features of the plug. Over a repeated number of plug-in/plug-out cycles, this mechanical stress can potentially deform the retention clamp 228 and/or the adjacent features of the plug. By placing the step-shaped transition 242 directly above or substantially close to directly above the front-facing side 208 of the rigid outer shell 206, most or all of the vertical force associated with the repeated plug in cycles is transferred to the front-facing side 208, which is a part of the rigid outer shell 206. In comparison to the design of the standard-plug-size HDMI cable 100, less force is applied to the portions of the second interior liner 246 and the male HDMI connector shell 222 that longitudinally extend away from the front-facing side 208, and are susceptible to deformation.

Another notable difference between the design of the smaller-plug-size HDMI cable 102 and the standard-plug-size HDMI cable 100 pertains to the vertical height of the step-shaped transition 242 relative to the vertical thickness of the elongated section 244 of the second interior liner 246. These two parameters are related to one another insofar as an increased vertical height of the step-shaped transition 242 requires a decreased thickness for the subjacent elongated section 244 of the second interior liner 246, and vice-versa. The height of the step-shaped transition 242 combined with the thickness of the elongated section 244 of the second interior liner 246 together serve to position the tooth 234 at the appropriate vertical position. In the design of the standard-plug-size HDMI cable 100, the step-shaped transition 126 is substantially greater than the thickness of the subjacent interior liner. By contrast, in the smaller-plug-size HDMI cable 102, the height of the step-shaped transition 242 is equal to or substantially close to the thickness of an elongated section 244 of second interior liner. By reducing the height of the step-shaped transition 242, the degree and distance to which the thinner portion 240 of the flexing arm 232 can deflect within the male HDMI connector shell 222 is reduced. This protects portions of the flexing arm 232 from weakening as a result of repeated plug-in/plug-out cycles by limiting the mechanical strain that is present in the flexing arm 232 during each plug-in/plug-out cycle.

Figure 4:
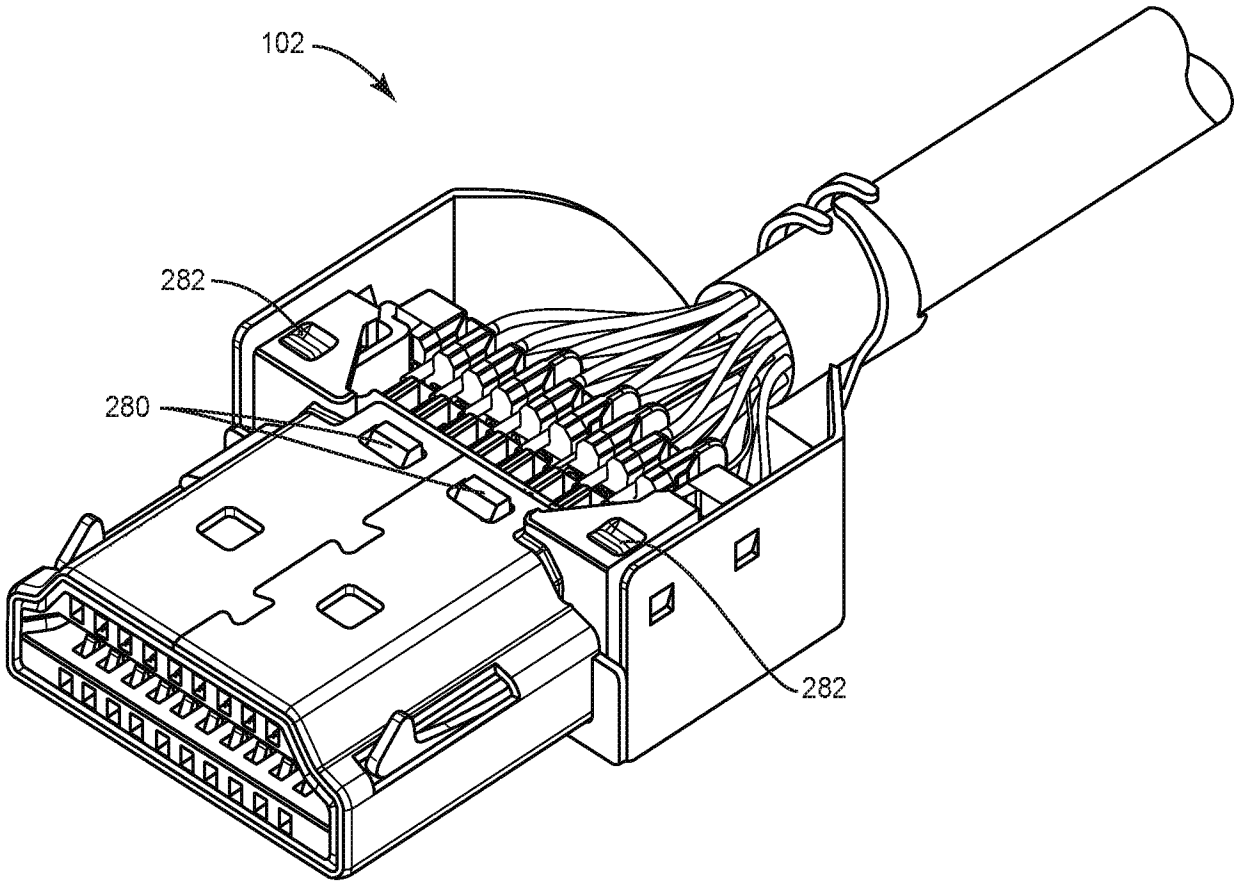
FIG. 4 depicts an isometric view of the smaller-plug-size size HDMI cable without the insulating outer coating and with the roof section removed, according to an embodiment.

Referring to FIG. 4, an isometric view of the smaller-plug-size HDMI cable 102 with the roof section 210 removed is depicted. This view reveals the mechanism for securing the pin housings to the rigid outer shell 206 and the male HDMI connector shell 222. The first (upper) pin housings 250 snap into the male HDMI connector shell 222 with protruding engagement features 280 (e.g., teeth) that extend through openings in the top side of the male HDMI connector shell 222. The second (lower) pin housings 252 also snap into the male HDMI connector shell 222 with similar protruding engagement features (not shown) at a lower side the HDMI connector shell 222. The male HDMI connector shell 222 snaps into the to the rigid outer shell 206 by further engagement features 282 (e.g., teeth). In this way, the male HDMI connector shell 222, the rigid outer shell 206 and the first (upper) pin housing 250 are physically coupled to one another. The interlocking of the male HDMI connector shell 222 with the pin housings and the rigid outer shell 206 provides a structure that sandwiches the first and second interior liners 254, 246 against the retention clamp 228 and holds the retention clamp 228 under all conditions.

Figure 5:
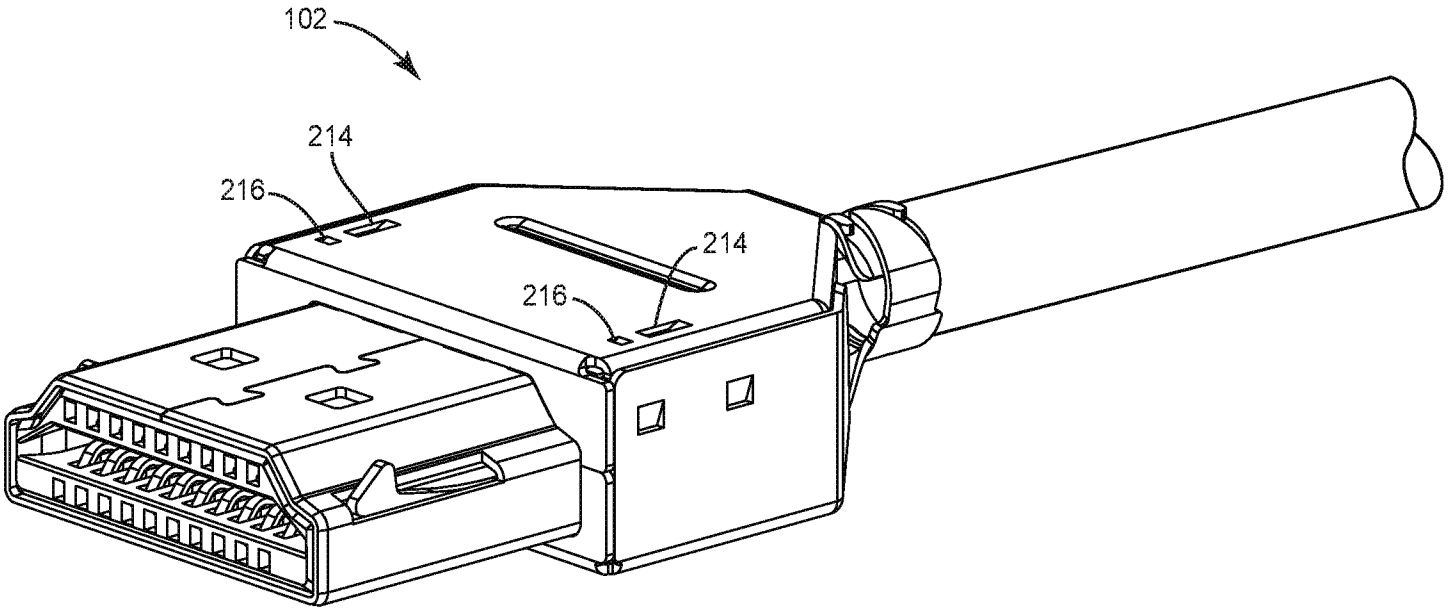
FIG. 5 depicts an isometric view of the smaller-plug-size size HDMI cable without the insulating outer coating and with the roof section included, according to an embodiment.

Referring to FIG. 5, an isometric view of the smaller-plug-size HDMI cable 102 with the roof section 210 included is depicted. The roof section 210 includes the first and second depressed portions 214, 216 as previously described with reference to FIG. 3. Corresponding first and second elevated portions 218, 220 are provided on the floor section 212 (not shown in FIG. 5) in a similar manner.

Figure 6:
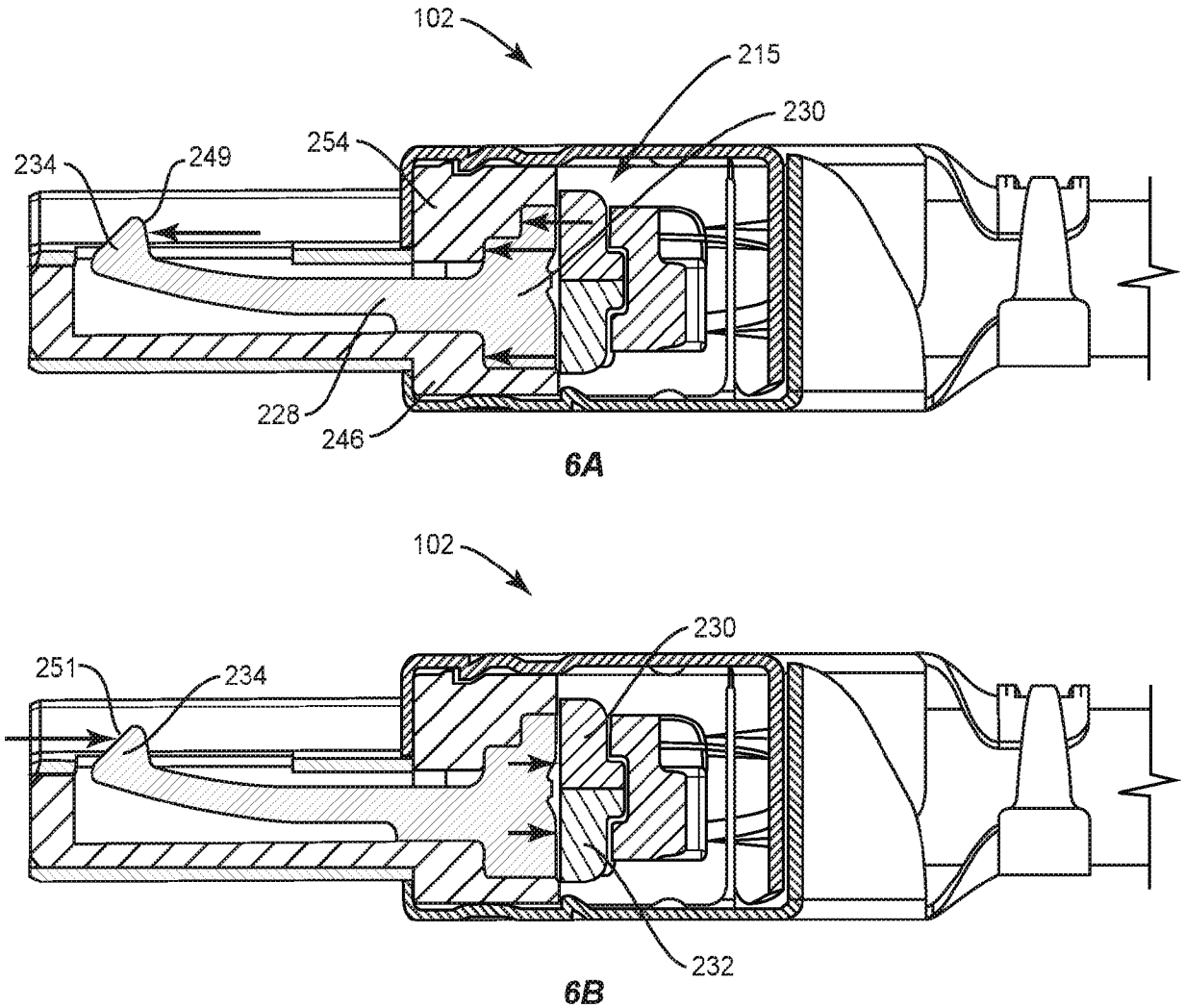
FIG. 6, which includes

Referring to FIG. 6, the retention clamp 228 is depicted with longitudinal forces applied by an external source. FIG. 6A depicts the longitudinal forces applied during unplugging of the smaller-plug-size HDMI cable 102. The leading edge of the female HDMI receptacle applies force to the inward-facing side 249 of the tooth 234, which in turn is transmitted to front-facing surfaces of the first and second first and second interior liners 254, 246 by opposite facing surfaces of the retention clamp 228. The first and second interior liners 254, 246 are longitudinally secured within the interior volume 215 and therefore maintain the anchor 230 in a fixed position during this operation. FIG. 6B depicts the longitudinal forces applied during plug-in of the smaller-plug-size HDMI cable 102. As can be seen, the female HDMI receptacle applies force to the outward-facing side 251 of the tooth 234, which in turn is transmitted to the planar front-facing surface of the first and second pin housings 250, 252. The first and second pin housings 250, 252 are longitudinally secured within the interior volume 215 and therefore maintain the anchor 230 in a fixed position during this operation.

Figure 7:
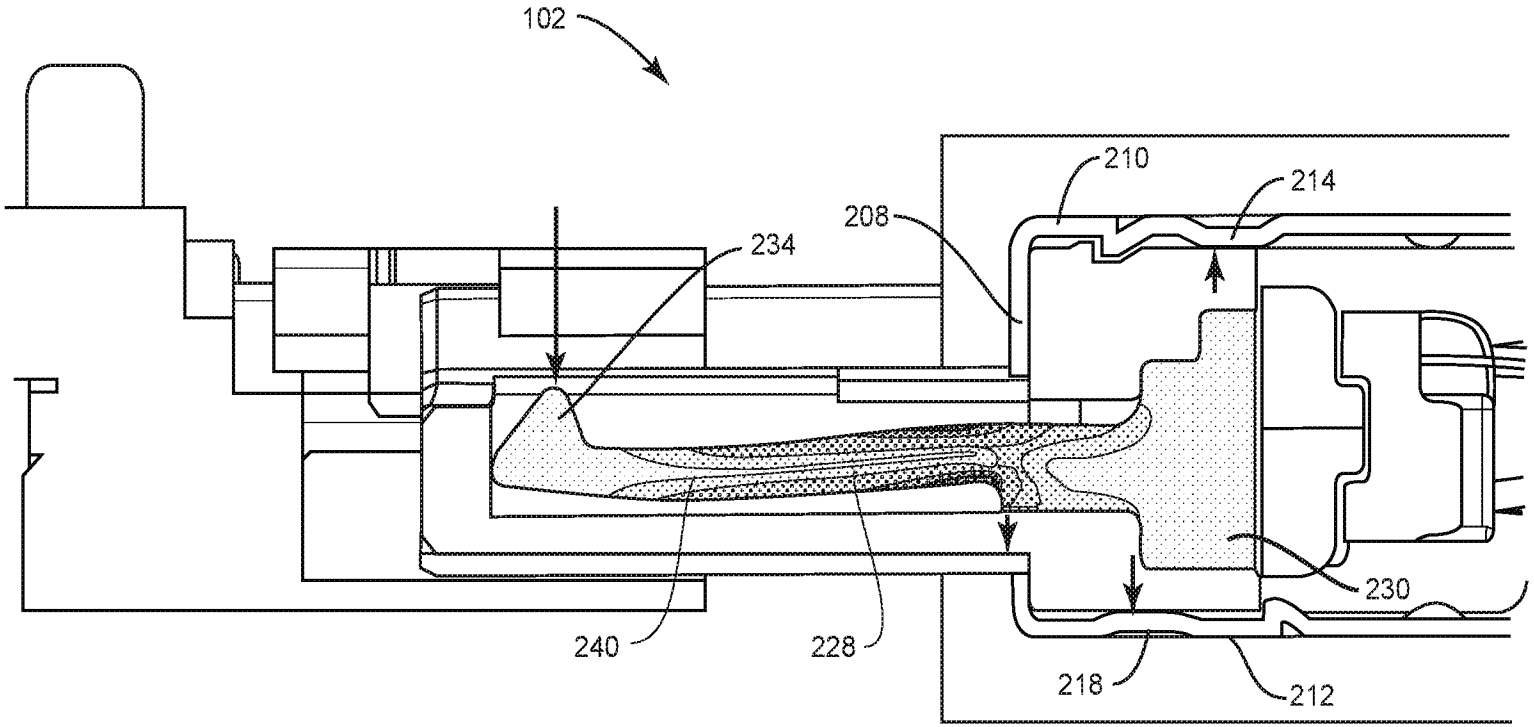
FIG. 7 depicts a cross-sectional view of the smaller-plug-size size HDMI cable and the vertical forces applied to the retention clamp during a plug-in or plug-out operation, according to an embodiment.

Referring to FIG. 7, the vertical forces applied by the retention clamp 228 to the surrounding structure are depicted. In this case, the retention clamp 228 is partially inserted in a female HDMI receptacle such that the retention clamp 228 is flexed downward. These vertical forces arise during either the plug-in or plug-out operation when the tooth 234 temporarily moves downward as it slides through the female HDMI receptacle. This causes the thinner portion 240 of the flexing arm 232 to vertically flex downward, which induces a spring force in the retention clamp 228. The anchor 230 experiences vertical force, which is distributed to the first depressed portion 214 of the roof section 210 and to the first elevated portion 218 of the floor section 212 in the manner previously described. Likewise, the thicker portion 238 of the flexing arm 232 applies downward force, which is mostly distributed over the front-facing side 208 in the manner previously described.

The terms "longitudinal," "longitudinally," and the like refer to a direction that is parallel to the sidewalls of the male HDMI connector shell 222. The terms "vertical," "vertically," and the like refer to a direction that is perpendicular to the sidewalls of the male HDMI connector shell 222.

The term "substantially" encompasses absolute conformity with a requirement as well as minor deviation from absolute conformity with the requirement due to manufacturing process variations, assembly, and other factors that may cause a deviation from the ideal. Provided that the deviations are not significant enough to prevent the structure from being assembled in the manner described herein, the term "substantially" encompasses any of these deviations.

The term "physical coupling," "physically coupled," and the like refer to a structural arrangement between two structures in which force exerted on one structure results in a substantially equal force being applied to the other structure.

Spatially relative terms such as "under," "below," "lower," "over," "upper" and the like, are used for ease of description to explain the positioning of one element relative to a second element. These terms are intended to encompass different orientations of the device in addition to different orientations than those depicted in the figures. Further, terms such as "first," "second," and the like, are also used to describe various elements, regions, sections, etc. and are also not intended to be limiting. Like terms refer to like elements throughout the description.

As used herein, the terms "having," "containing," "including," "comprising" and the like are open-ended terms that indicate the presence of stated elements or features, but do not preclude additional elements or features. The articles "a," "an" and "the" are intended to include the plural as well as the singular, unless the context clearly indicates otherwise.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A high-definition multimedia interface (HDMI) plug, comprising:

a plug body section comprising a rigid outer shell, the rigid outer comprising a roof section, a floor section vertically spaced apart from the roof section, and a front-facing side connected to the roof and floor sections, the front-facing side and roof and floor sections collectively enclosing an interior volume;

a male HDMI connector shell that is secured to the rigid outer shell and longitudinally extends away from the front-facing side;

a retention clamp disposed within the interior volume and the male HDMI connector shell, the retention clamp comprising an anchor disposed within the interior volume, a flexing arm that extends away from the anchor and through the male HDMI connector shell, and a tooth disposed at an end of the flexing arm that extends out of a first opening in the male HDMI connector shell, first and second pin housings that are disposed in the interior volume and secured to the rigid outer shell; and first and second interior liners that are disposed in the interior volume between the rigid outer shell and the retention clamp;

wherein the anchor comprises a widest longitudinal section that is defined by an upward-facing surface, a downward-facing surface, and a generally planar rear-facing surface extending between the upward and downward-facing surfaces, the upward-facing and downward-facing surfaces each forming a substantially right angle with the rear-facing surface, wherein the rear-facing surface is flush against the first and second pin housings, wherein the upward-facing surface is flush against the first interior liner, and wherein the downward-facing surface is flush against the second interior liner.

2. The HDMI plug of claim 1, wherein the flexing arm comprises a thicker portion, a thinner portion, and a step-shaped transition between the thicker portion and the thinner portion, the thicker portion directly adjoining the anchor and longitudinally extending from the interior volume into the male HDMI connector, the thinner portion directly adjoining the thicker portion and longitudinally extending through the male HDMI connector to the first opening, the step-shaped transition being disposed generally above the front-facing side of the rigid outer shell.

3. The HDMI plug of claim 2, wherein a height of the step shaped transition is generally equal to a thickness of an elongated section of the second interior liner, the elongated section of the second interior liner extending from inside of the interior volume through the male HDMI connector shell and facing a lower side of the flexing arm that is opposite form the tooth.

4. The HDMI plug of claim 1, wherein the first interior liner physically couples the anchor to the roof section of the rigid outer shell so as to prevent the anchor from vertically moving towards the roof section, and wherein the second interior liner physically couples the anchor to the floor section of the rigid outer shell so as to prevent the anchor from vertically moving towards the floor section.

5. The HDMI plug of claim 4, wherein the first and second interior liners each comprise first and second opposing surfaces, the first surface of the first interior liner being flush against at least a portion of the roof section, the second surface of the first interior liner being flush against the upward-facing surface of the anchor, the first surface of the second interior liner being flush against at least a portion of the floor section, the second surface of the second interior liner being flush against the downward-facing surface of the anchor.

6. The HDMI plug of claim 5, wherein the roof section comprises a depressed portion that is flush against the first surface of the first interior liner, and wherein the floor section comprises an elevated portion that is flush against the first surface of the second interior liner.

7. The HDMI plug of claim 1, wherein the first and second pin housings form a planar front-facing surface that faces and is flush against the rear-facing surface of the anchor.

8. The HDMI plug of claim 7, wherein the anchor is disposed in a front section of the interior volume that is completely in front of the first and second pin housings.

9. The HDMI plug of claim 7, wherein the widest longitudinal section further comprises first and second rounded corners extending between the upward-facing and downward-facing, respectively, and first and second planar surfaces of the rear-facing surface, the first and second planar surfaces being coplanar with one another, and wherein the front-facing surface of the first and second pin housings is flush against an entire length of the first and second planar surfaces.

10. A high-definition multimedia interface (HDMI) plug, comprising:

a plug body section comprising a rigid outer shell, the rigid outer comprising a roof section, a floor section vertically spaced apart from the roof section, and a front-facing side connected to the roof and floor sections, the front-facing side and roof and floor sections collectively enclosing an interior volume;

a male HDMI connector shell that is secured to the rigid outer shell and longitudinally extends away from the front-facing side;

a retention clamp disposed within the interior volume and the male HDMI connector shell, the retention clamp comprising an anchor disposed within the interior volume, a flexing arm that extends away from the anchor and through the male HDMI connector shell, and a tooth disposed at an end of the flexing arm that extends out of a first opening in the male HDMI connector shell, wherein the anchor is vertically stabilized within the interior volume by:

a first interior liner that physically couples an upward-facing surface of the anchor to the roof section; and a second interior liner that physically couples a downward-facing surface of the anchor to the floor section.

11. The HDMI plug of claim 10, wherein the flexing arm comprises a thicker portion, a thinner portion, and a step-shaped transition between the thicker portion and the thinner portion, the thicker portion directly adjoining the anchor and longitudinally extending from the interior volume into the male HDMI connector, the thinner portion directly adjoining the thicker portion and longitudinally extending through the male HDMI connector to the first opening, the step-shaped transition being disposed generally above the front-facing side of the rigid outer shell.

12. The HDMI plug of claim 10, wherein the anchor is longitudinally stabilized within the interior volume by first and second pin housings that are secured to the rigid outer shell, and wherein the first and second pin housings form a planar front-facing surface that faces and is flush against a generally planar rear-facing surface of the anchor.

13. The HDMI plug of claim 12, wherein the anchor is disposed in a front section of the interior volume that is completely in front of the first and second pin housings.

14. The HDMI plug of claim 10, wherein the roof section comprises a depressed portion that is flush against the first interior liner, and wherein the floor section comprises an elevated portion that is flush against the second interior liner.

15. The HDMI plug of claim 14, wherein a height of the step shaped transition is generally equal to a thickness of an elongated section of the second interior liner, the elongated section of the second interior liner extending from inside of the interior volume through the male HDMI connector shell and facing a lower side of the flexing arm that is opposite form the tooth.

16. A high-definition multimedia interface (HDMI) plug, comprising:

a plug body section comprising a rigid outer shell, the rigid outer comprising a roof section, a floor section vertically spaced apart from the roof section, and a front-facing side connected to the roof and floor sections, the front-facing side and roof and floor sections collectively enclosing an interior volume;

a male HDMI connector shell that is secured to the rigid outer shell and longitudinally extends away from the front-facing side;

a retention clamp disposed within the interior volume and the male HDMI connector shell, the retention clamp comprising an anchor disposed within the interior volume, a flexing arm that extends away from the anchor and through the male HDMI connector shell, and a tooth disposed at an end of the flexing arm that extends out of a first opening in the male HDMI connector shell, an anchoring cavity disposed within the interior volume, the anchoring cavity having a complementary shape as the anchor and being engaged with the anchor, wherein the anchor comprises a widest longitudinal section that is defined by an upward-facing surface, a downward-facing surface, and a generally planar rear-facing surface extending between the upward and downward-facing surfaces, the upward-facing and downward-facing surfaces each forming a substantially right angle with the rear-facing surface, wherein the anchoring cavity comprises: a first vertical surface that is flush against a rear-facing surface of the widest longitudinal section of the anchor, a first longitudinal surface that is flush against an upward-facing surface of the widest longitudinal section of the anchor; and a second longitudinal surface that is flush against a downward-facing surface of the widest longitudinal section of the anchor.

17. The HDMI plug of claim 16, wherein the widest longitudinal section further comprises first and second rounded corners extending between the upward-facing and downward-facing, respectively, and first and second planar surfaces of the rear-facing surface, the first and second planar surfaces being coplanar with one another, and wherein the first vertical surface is flush against an entire length of the first and second planar surfaces.

18. The HDMI plug of claim 16, wherein the flexing arm comprises a thicker portion, a thinner portion, and a step-shaped transition between the thicker portion and the thinner portion, the thicker portion directly adjoining the anchor and longitudinally extending from the interior volume into the male HDMI connector, the thinner portion directly adjoining the thicker portion and longitudinally extending through the male HDMI connector to the first opening, the step-shaped transition being disposed generally above the front-facing side of the rigid outer shell.

19. The HDMI plug of claim 18, wherein a height of the step shaped transition is generally equal to a thickness of an elongated section of the second interior, the elongated section of the second interior liner extending from inside of the interior volume through the male HDMI connector shell and facing a lower side of the flexing arm that is opposite form the tooth.

* * * * *